United States Patent [19]

Apeland

[11] Patent Number: 4,717,470

[45] Date of Patent: Jan. 5, 1988

[54] METHOD FOR CLASSIFYING SAND

[76] Inventor: Ivar Apeland, N-4137 Årdal, Norway

[21] Appl. No.: 759,928

[22] Filed: Jul. 29, 1985

Related U.S. Application Data

[63] Continuation of Ser. No. 581,074, Feb. 17, 1984, abandoned.

[30] Foreign Application Priority Data

Mar. 24, 1983 [NO] Norway ..... 831049

[51] Int. Cl.[4] ..... B03B 5/62; B03B 5/64

[52] U.S. Cl. ..... 209/17; 209/156; 209/208; 210/194

[58] Field of Search ..... 209/158, 17, 155, 156, 209/157, 173, 496, 208, 13, 172, 172.5; 210/194, 536, 540, 519

[56] References Cited

U.S. PATENT DOCUMENTS

| | | | |
|---|---|---|---|
| 308,410 | 11/1884 | Hanson | 209/17 |
| 1,337,279 | 4/1920 | Sensibar | 209/208 |
| 1,375,211 | 4/1921 | Cole | 209/208 |
| 1,477,955 | 12/1923 | Henry | 209/501 |
| 1,637,625 | 8/1927 | Shaw | 209/158 |
| 1,646,753 | 10/1957 | Lansrad | 209/208 |
| 2,319,457 | 5/1943 | Hirst | 209/172.5 |
| 2,365,734 | 12/1944 | Tromp | 209/172.5 |
| 2,368,416 | 1/1945 | Holt | 209/172.5 |
| 2,440,097 | 4/1948 | Kear | 209/155 |
| 2,714,956 | 8/1955 | Marston | 209/158 |
| 2,760,634 | 8/1956 | Saxe | 209/208 |
| 2,817,440 | 12/1957 | Casner et al. | 209/208 |
| 2,822,922 | 2/1958 | Thundle | 209/155 |
| 2,865,503 | 12/1958 | Thamme | 209/155 |
| 3,129,849 | 4/1964 | Cochran | 209/496 |
| 3,160,321 | 12/1964 | Cochran | 209/208 |
| 3,262,560 | 7/1966 | Lillig et al. | 209/156 |
| 3,596,759 | 8/1971 | King | 209/13 |
| 3,930,879 | 1/1976 | Erickson | 210/540 |

FOREIGN PATENT DOCUMENTS

| | | | |
|---|---|---|---|
| 469240 | 11/1950 | Canada | 209/17 |
| 28532 | of 1905 | United Kingdom | 210/194 |
| 238158 | 8/1925 | United Kingdom | 209/156 |
| 340242 | 12/1930 | United Kingdom | 209/158 |
| 546186 | 8/1941 | United Kingdom | 209/172 |
| 2055309 | 3/1981 | United Kingdom | 209/208 |

*Primary Examiner*—S. Leon Bashore
*Assistant Examiner*—Thomas M. Lithgow
*Attorney, Agent, or Firm*—Schwartz, Jeffery, Schwaab, Mack, Blumenthal & Evans

[57] ABSTRACT

A method for classifying sand wherein a mixture of sand and water is introduced into a classification tank (7) partially filled with water. Depending on the weight of the sand grains, the grains of sand will precipitate at the bottom (8) of the tank (7) at graduated distances from an inlet pipe (6), the heavier particles nearest the inlet and the lighter particles farther away.

To prevent large quantities of fines, i.e., sand grains between about 0.002 mm and 0.006 mm in size, from being lost by being washed out of the tank (7) together with the overflow water, the water from the tank (7) is recirculated by means of a pump (14) so that the water becomes progressively more saturated with fines, which means that larger amounts of fines will precipitate in the tank (7).

Because the water is recirculated, water consumption can be reduced by ⅔, and at the same time the problem of the overflow water from the tank (7) is also reduced.

10 Claims, 1 Drawing Figure

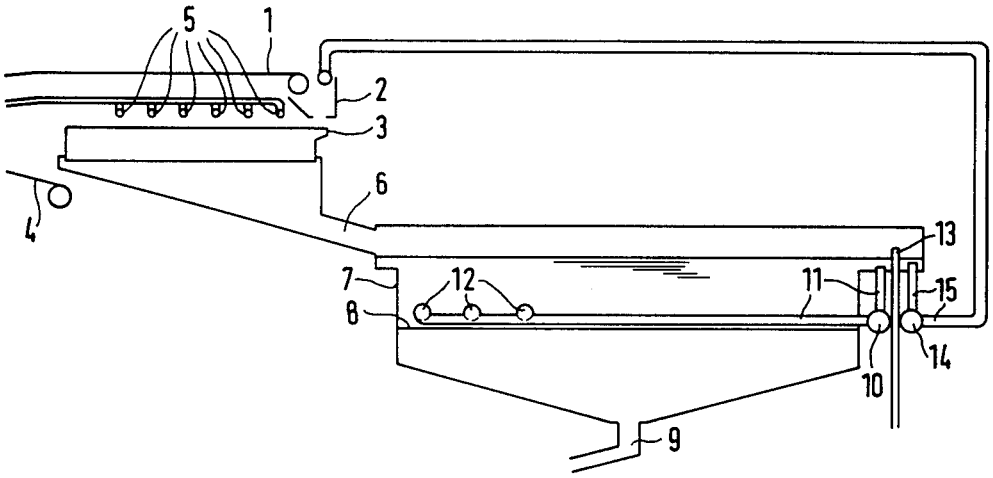
5
1
2
3
4
6
13
7
12
11
15
8
14
10
9

METHOD FOR CLASSIFYING SAND

This application is a continuation of application Ser. No. 581,074, filed Feb. 17, 1984, now abandoned.

BACKGROUND OF THE INVENTION

1. Field of the Invention

The invention relates to a method for classifying sand.

Classified sand, that is, sand containing specified proportions of different-size sand grains per unit of volume, is normally produced by introducing a mixture of sand and water at a predetermined rate into a "classification tank". The tank is partially filled with water, and when the sand/water mixture is introduced into the tank through an inlet pipe, the grains of sand will sink to the bottom of the tank. The grains of sand precipitate in the bottom of the tank at graduated distances from the inlet, depending upon their weight, the heavier particles precipitating nearest the inlet and the lighter particles gradually farther away. There are a number of valves provided at the bottom of the tank, and when the valves are opened the overlying sand can pass through the valve into a common outlet pipe. Depending on which valves are opened, and for how long, sand of a predetermined composition—"classified sand"—is thereby produced.

2. Prior Art

Recent studies have shown that substantial savings of cement and a concrete of substantially improved castability can be obtained if the sand that is utilized contains a certain quantity of fines, i.e., grains of sand between 0.002 mm and 0.006 mm in size. Such particles, however, are so lightweight that with the classification processes utilized today, much of this material is simply lost, being washed out of the tank together with the overflow water.

To recover the fines from the overflow water usually requires the use of costly auxiliary equipment such as cyclones and centrifuges.

Another drawback of the classification processes used today is that they require an enormous quantity of water.

OBJECTS AND SUMMARY

The object of the present invention is to provide a method for classifying sand whereby a larger percentage of the fines is retained while at the same time the water requirement is reduced.

This object is obtained in that fines-containing water from the classification tank; from the overflow pipe of the classification tank; and/or from a precipitation basin in connection with the classification tank, is recirculated and admixed with the sand/water mixture that is introduced into the classification tank.

BRIEF DESCRIPTION OF THE DRAWING

An exemplary embodiment of the invention is illustrated in schematic manner in the accompanying drawing, which shows an assembly for producing classified sand, in side view.

DETAILED DESCRIPTION OF THE INVENTION

The drawing shows a conveyor belt 1 which transports sand supplied from a hopper 2 to a sieve 3. The sieve 3 is adapted to be moved such that larger particles, preferably coarse sand, which are too large to pass through the sieve 3, are guided along the sieve to a conveyor belt 4 that carries the coarse particles away. The sand particles that pass through the sieve 3 are admixed with large amounts of water via nozzles 5. The sand/water mixture is then guided via an inlet pipe 6 into a water-filled tank 7. Depending on the size of the grains of sand, the sand will precipitate at the bottom 8 of the tank 7 at varying distances from the inlet 6, the heavier particles precipitating nearest the inlet and the smaller, lighter particles gradually farther away. At the bottom 8 of the tank 7, a number of valves (not illustrated in the drawing) are provided, through which the grains of sand of different sizes may be guided to a common outlet pipe 9. Depending on the duration of the opening time of the respective valves, and which valves are opened, sand of a predetermined composition, or "classified sand", is produced. To ensure that the sand mass introduced into the tank 7 is spread relatively uniformly along the bottom 8 of the tank 7, a pump 10 is provided which via pipes 11 pumps water up through nozzles 12. An overflow pipe 13 is also provided in the tank 7, through which water can be carried off, perhaps through an optional precipitation basin (not illustrated). To prevent the fines in the sand from being washed away together with the overflow water, a pump 14 is provided in connection with the tank 7 which via a pipe 15 leads water from the tank 7 to the hopper 2. The inlet opening of the pipe 15 is at a lower level than the inlet opening of the overflow pipe 13, and depending on the capacity of the pump 14, a desired amount of water can be recirculated. Because the water that is recirculated will contain fines material, the water will gradually become more saturated with such material, which naturally means that large quantities of fines will precipitate in the bottom of the tank 7 and can then be removed via the valves at the bottom of the tank 7.

By recirculating the water, one can reduce the water requirement by about $\frac{2}{3}$, while at the same time reducing the problem of overflow water from the tank 7. If desired, the water for recirculation can be pumped from the overflow pipe 13 or from a precipitation basin (not shown) into which the overflow pipe 13 empties.

I claim:

1. An apparatus for the production of classified sand containing different-size sand grains including fines and for the conservation of water, said apparatus including a classification tank containing water and further comprising:

(a) a generally horizontal sieve at an inlet end of said classification tank into which a mixture of water and raw sand materials is introduced through said sieve, said sieve being located completely above the water level in said tank, (b) said tank having a bottom on which settling takes place, (c) means at said bottom for receiving classified sand, (d) a common outlet pipe means for the classified sand at a level below said bottom, (e) an overflow means in said tank for receiving overflow water, and (f) recirculation means partially in said tank for also receiving overflow water containing fines, said recirculation means having an inlet at an end opposite said inlet end and an outlet above said sieve where the raw sand material is originally introduced, said recirculated overflow water containing fines flows through said sieve and into said tank, thereby recirculating the fines to increase the percentage of fines precipitated to said bottom and retained in the classified sand and decreasing the percentage of fines flowing out of the tank through said overflow means, as well as conserving water by restricting the supply of fresh water required.

2. An apparatus as defined in claim 1 wherein said overflow means and said recirculation means each have an inlet, and the inlet of said recirculation means is below the inlet of said overflow means.

3. An apparatus as defined in claim 1 including means for spreading sand substantially uniformly along said bottom.

4. An apparatus as defined in claim 3 wherein said spreading means includes means for pumping water through a plurality of nozzles positioned on said bottom.

5. An apparatus as defined in claim 1 wherein said recirculation and overflow means includes a first overflow pipe and a second overflow pipe respectively, a pump means connected to said first overflow pipe for pumping the water containing fines.

6. An apparatus as defined in claim 5 wherein the inlet of said second overflow pipe is a lower level than the inlet of said first overflow pipe.

7. A method for production of classified sand containing different-size sand grains including fines and for the conservation of water, the classification of the sand occuring in a classification tank containing water, the method comprising:

(a) introducing a mixture of raw sand and water to a generally horizontal sieve, the sieve located completely above the water level in the tank, (b) feeding the water and sand which flows through the sieve to the inlet end of the tank, the tank having a bottom, (c) settling the sand to the bottom and allowing water containing fines to overflow said tank, (d) discharging classified sand through an outlet pipe at a level below the bottom of the tank, (e) discharging a portion of the overflow water containing fines through an overflow means, and (f) recirculating a second portion of the overflow water containing fines through an inlet at an end opposite said inlet end to an outlet above the sieve, the recirculated water containing fines is flowed through the sieve and back into the tank at the inlet end, thereby increasing the percentage of fines precipitated to the bottom and retained in the classified sand and decreasing the percentage of fines flowing out of the tank through the overflow means, as well as conserving water.

8. The method of claim 7 including spreading sand substantially uniformly along the bottom.

9. The method of claim 8 wherein said spreading step includes pumping water through a plurality of nozzles positioned on the bottom.

10. The method of claim 7 wherein said recirculation step includes overflowing water containing fines through an overflow pipe and pumping water containing fines from the overflow pipe.

* * * * *